US008007716B2

(12) United States Patent
Suda et al.

(10) Patent No.: US 8,007,716 B2
(45) Date of Patent: Aug. 30, 2011

(54) STEEL WIRE FOR HIGH STRENGTH SPRING EXCELLENT IN WORKABILITY AND HIGH STRENGTH

(75) Inventors: Sumie Suda, Kobe (JP); Nobuhiko Ibaraki, Kobe (JP); Noritoshi Takamura, Kanagawa (JP); Naoki Terakado, Nagano (JP); Satoru Tendo, Nagano (JP); Tadayoshi Fujiwara, Amagasaki (JP); Tetsuo Jinbo, Amagasaki (JP)

(73) Assignees: Kabushiki Kaisha Kobe Seiko Sho, Kobe-shi (JP); NHK Spring Co., Ltd., Yokohama-shi (JP); Shinko Wire Co., Ltd., Amagasaki-shi (JP)

( * ) Notice: Subject to any disclaimer, the term of this patent is extended or adjusted under 35 U.S.C. 154(b) by 122 days.

(21) Appl. No.: 10/549,753

(22) PCT Filed: Mar. 25, 2004

(86) PCT No.: PCT/JP2004/004195

§ 371 (c)(1),
(2), (4) Date: Sep. 21, 2005

(87) PCT Pub. No.: WO2004/087978

PCT Pub. Date: Oct. 14, 2004

(65) Prior Publication Data

US 2006/0201588 A1 Sep. 14, 2006

(30) Foreign Application Priority Data

Mar. 28, 2003 (JP) ..... 2003-092600

(51) Int. Cl.
*C22C 38/18* (2006.01)
*C22C 38/00* (2006.01)
*C23C 8/26* (2006.01)

(52) U.S. Cl. ..... 420/104; 148/318; 148/333

(58) Field of Classification Search ..... 148/318, 148/333; 420/104
See application file for complete search history.

(56) References Cited

U.S. PATENT DOCUMENTS

| | | | |
|---|---|---|---|
| 6,338,763 | B1 | 1/2002 | Hashimura et al. |
| 2003/0024610 | A1 | 2/2003 | Ibakaki et al. |
| 2006/0201588 | A1 | 9/2006 | Suda et al. |

FOREIGN PATENT DOCUMENTS

| | | | |
|---|---|---|---|
| EP | 1 361 289 | A1 | 11/2003 |
| JP | 2-107746 | | 4/1990 |
| JP | 4-88123 | | 3/1992 |
| JP | 4-247824 | | 9/1992 |
| JP | 6-220579 | | 8/1994 |
| JP | 7-26347 | | 1/1995 |
| JP | 2783145 | | 8/1998 |

OTHER PUBLICATIONS

Davis et al., Fracture Toughness Properties-Effects of Microstructure and Heat Treatment, Metals Handbook Desk Edition, ASM International, 1998, 2nd Edition, p. 5.*
U.S. Appl. No. 12/160,913, filed Jul. 15, 2008, Kochi, et al.

* cited by examiner

*Primary Examiner* — Roy King
*Assistant Examiner* — Caitlin Fogarty
(74) *Attorney, Agent, or Firm* — Oblon, Spivak, McClelland, Maier & Neustadt, L.L.P.

(57) ABSTRACT

A steel wire has tempered martensite, comprises, as essential components, by mass, C: 0.53 to 0.68%; Si: 1.2 to 2.5%; Mn: 0.2 to 1.5%; Cr: 1.4 to 2.5%; Al: 0.05% or less; further comprises, as a selective component, Ni: 0.4% or less; V: 0.4% or less; Mo: 0.05 to 0.5%; or Nb: 0.05 to 0.5%; and further comprises remainder essentially consisting of Fe and inevitable impurities, wherein the grain size number of prior austenite is 11.0 or larger, and the proof stress ratio ($\sigma_{0.2}/\sigma_B$), namely, a ratio of 0.2% proof stress ($\sigma_{0.2}$) to tensile strength ($\sigma_B$) is 0.85 or lower. Satisfying the above requirements makes it possible to produce a steel wire for high-strength spring excellent both in workability (cold workability), and in sag resistance and fatigue properties.

7 Claims, No Drawings

STEEL WIRE FOR HIGH STRENGTH SPRING EXCELLENT IN WORKABILITY AND HIGH STRENGTH

TECHNICAL FIELD

The present invention relates to a steel wire for high-strength spring and high-strength springs having superior fatigue properties and sag resistance without sacrificing the cold workability (coiling performance) of the steel wire.

BACKGROUND ART

As development of light-weighted construction and high performance for automotive vehicles has progressed, high stress design has been required for valve springs in automotive engines, suspension springs, clutch springs, brake springs, and the like.

For instance, a low sag resistance of a spring may increase the sag amount of the spring while a high load stress is exerted to the spring. As a result, the rotating speed of the engine may not be raised as expected in the design, thereby leading to poor responsiveness. Therefore, there is a demand for springs having superior sag resistance.

There is known that use of a high-strength spring material is effective in improving sag resistance of springs. Also, it is conceived that use of the high-strength spring material is effective in improving fatigue properties of the springs from the viewpoint of fatigue limit. For instance, there is known a technique of improving fatigue strength and sag resistance of springs by regulating the chemical composition of the spring material, and by increasing the tensile strength of the spring material after quenching and tempering, namely, after an oil tempering process. Also, there is known a technique of improving sag resistance of springs by adding a large quantity of an alloy element such as silicon (Si) to the spring material (see Japanese Patent No. 2898472, and Japanese Unexamined Patent Publication No. 2000-169937).

Despite these efforts, springs may encounter breakage trouble in an attempt of improving fatigue properties and sag resistance by increasing the tensile strength of the spring material. Further, in an attempt of improving sag resistance by adding a large quantity of an alloy element, resultant springs may have excessively high sensitivity to surface flaws and internal defects. As a result, it is highly likely that the springs suffer from breakage trouble resulting from the defective parts in assembling or in use.

As mentioned above, it is not easy to improve sag resistance and fatigue properties of springs without sacrificing workability (cold workability) of the spring material.

In view of the above, it is an object of the present invention to provide a steel wire for high-strength spring, and high-strength springs having superior sag resistance and fatigue properties without sacrificing workability (cold workability) of the steel wire.

DISCLOSURE OF THE INVENTION

As a result of an extensive study to solve the above problems, the inventors found that adding an alloy element of a large quantity to improve fatigue properties and sag resistance of springs, and setting a yield strength ratio ($\sigma_{0.2}/\sigma_B$) at 0.85 or lower provides superior coiling performance (cold workability). Furthermore, the inventors found that fining the grain of the steel wire leads to further improvement on fatigue life and sag resistance of the springs. They also found that sag resistance can be improved without lowering defect sensitivity, despite addition of chromium of a large quantity, and thus accomplished the present invention.

According to an aspect of the present invention, a steel wire for high-strength spring having superior workability comprises by mass, C: 0.53 to 0.68%; Si: 1.2 to 2.5%; Mn: 0.2 to 1.5% (for instance, 0.5 to 1.5%); Cr: 1.4 to 2.5%; Al: 0.05% or less, excluding 0%; at least one selected from the group consisting of Ni: 0.4% or less, excluding 0%; V: 0.4% or less, excluding 0%; Mo: 0.05 to 0.5%; and Nb: 0.05 to 0.5%; and remainder essentially consisting of Fe and inevitable impurities. The inventive steel wire has tempered martensite, wherein the prior austenite grain size number is 11.0 or larger, and a ratio ($\sigma_{0.2}/\sigma_B$) of 0.2% proof stress ($\sigma_{0.2}$) to tensile strength ($\sigma_B$) is 0.85 or lower.

Preferably, the steel wire has a property that 0.2% proof stress ($\sigma_{0.2}$) is raised by 300 MPa or more when annealing at 400° C. for 20 minutes is conducted.

According to another aspect of the present invention, a high-strength spring is formed of the inventive steel wire. Preferably, the spring has a core part of a hardness Hv ranging from about 550 to about 700, and the residual stress of the spring is changed from a compression to a tension at a depth of from about 0.05 mm to about 0.5 mm from the surface of the spring. The inventive spring is producible irrespective of a state as to whether surface hardening such as a nitriding process is conducted. In case that the surface hardening is not conducted, it is desirable that the compressive residual stress on the surface of the spring is −400 MPa or lower. In case that the surface hardening is conducted, namely, a nitride layer is formed on the spring surface, it is desirable that the compressive residual stress on the surface of the spring is −800 MPa or lower; and a hardness Hv on the spring surface ranges from about 750 to about 1150. The spring may have a hard layer of a hardness Hv larger than the hardness of the core part by 15 or more, and the thickness of the hard layer is, for instance, 0.02 mm or more.

BEST MODE FOR CARRYING OUT THE INVENTION

A steel wire and spring according to a preferred embodiment of the present invention contains C, Si, Mn, Cr, and Al as essential components, and further contains at least one selected from the group consisting of Ni, V, Mo, and Nb, with remainder essentially consisting of Fe and inevitable impurities. Hereinafter, the amounts of the respective components, and reasons for defining the amounts are described.

C: 0.53 to 0.68% by Mass (Hereinafter, "% by Mass" is Simply Referred to as "%".)

Carbon is an indispensable element for securing sufficient high strength steel for spring under a high load stress, and for improving fatigue life and sag resistance of springs. In view of this, a lower limit of the carbon content is 0.53%. An excessive addition of carbon may undesirably lower toughness and ductility of the steel for spring. As a result, it is highly likely that crack may be generated during production or use of springs, resulting from surface flaws or internal defects of the springs. In view of this, an upper limit of the carbon content is 0.68%. Preferably, the carbon content ranges from 0.58% to 0.65%.

Si: 1.2 to 2.5%

Silicon is an essential element as an deoxidizer to be added in a steel production process. Silicon is a useful element in increasing softening resistance and improving sag resistance of springs. In view of this, a lower limit of the silicon content is 1.2%. An excessive addition of silicon not only lowers toughness and ductility of the spring steel, but also is likely to shorten the fatigue life of springs by increasing the number of flaws, by accelerating de-carbonization on the steel surface in heat treatment, and increasing the thickness a grain boundary oxidation. In view of this, an upper limit of the silicon content is 2.5%. Preferably, the silicon content ranges from 1.3% to 2.4%.

Mn: 0.2 to 1.5%

Manganese is an effective element in deoxidization in a steel production process. Manganese is an element that raises quenching performance (hardenability) and accordingly contributes to increase in strength, as well as to improvement on fatigue life and sag resistance. In view of this, a lower limit of the manganese content is 0.2%. Preferably, the manganese content is 0.3% or higher, particularly, 0.4% or higher, e.g., 0.5% or higher. Considering that the inventive steel wire (and the inventive spring) is produced by subjecting the steel to hot rolling, and patenting if desired, which follows by wire drawing, oil tempering, coiling or the like, an excessive addition of manganese is likely to cause transformation into supercooled structure such as bainite or the like, for example, in hot rolling or patenting, which results in lowering wire drawability. In view of this, an upper limit of the manganese content is 1.5%. Preferably, the manganese content is 1.0% or lower.

Cr: 1.4 to 2.5%

Chromium is an important element in the present invention because it has an action of improving sag resistance and suppressing defect sensitivity. Chromium has an action of increasing the thickness of an oxide layer in grain boundaries, thereby shortening fatigue life of springs. The thickness of the oxide layer in grain boundaries, however, can be reduced by controlling the atmosphere in an oil tempering process, specifically, by supplying water vapors of about 3 to 80 volumetric % into the oil tempering process to thereby form a dense oxide coat on an oil-tempered wire. Thus, a drawback resulting from an oxide layer of a large thickness can be eliminated. The greater the chromium content is, the more effectively a preferred result is obtainable. In view of this, the chromium content is 1.4% or higher, preferably, 1.45% or higher, and more preferably, 1.5% or higher. An excessive addition of chromium may extend the patenting time in wire drawing, and may lower toughness and ductility of the spring steel. In view of this, the chromium content is 2.5% or lower, and preferably, 2.0% or lower.

In the inventive steel wire and the inventive spring, the depth of an oxide layer in grain boundaries is normally about 10 μm or less.

Al: 0.05% or Less, Excluding 0%

Aluminum has an action of fining the grain in austenization, thereby improving toughness and ductility of the spring steel. An excessive addition of aluminum, however, may increase oversized non-metallic inclusions such as $Al_2O_3$, which may deteriorate fatigue properties of the springs. In view of this, an upper limit of the aluminum content is 0.05%, and preferably, 0.04%.

Ni: 0.4% or Less, Excluding 0%

Nickel is a useful element for raising hardenability and preventing low temperature embrittlement. An excessive addition of nickel may generate bainite or martensite in hot rolling, thereby lowering toughness and ductility of the spring steel. In view of this, an upper limit of the nickel content is 0.4%, and preferably 0.3%. Preferably, the nickel content is 0.1% or higher.

V: 0.4% or Less, Excluding 0%

Vanadium has an action of fining the grain in heat treatment such as an oil tempering process (quenching and tempering), thereby raising toughness and ductility of the spring steel. Further, vanadium causes secondary precipitation in hardening quenching/tempering, and low temperature annealing for stress relieving after coiling. The hardening contributes to providing the spring steel with high strength. An excessive addition of vanadium, however, may generate martensite or bainite in hot rolling or in patenting, thereby deteriorating workability of the spring steel. In view of this, an upper limit of the vanadium content is 0.4%, and preferably, 0.3%. Preferably, the vanadium content is 0.1% or higher.

Mo: 0.05 to 0.5%

Molybdenum is a useful element for raising softening resistance, allowing the spring steel to exhibit a hardening effect by precipitation, and raising proof stress after low-temperature annealing. In view of this, the molybdenum content is, for example, 0.05% or higher, and preferably, 0.10% or higher. An excessive addition of molybdenum, however, may generate martensite or bainite in the course of time until an oil tempering process is implemented, thereby deteriorating workability of the spring steel. In view of this, an upper limit of the molybdenum content is 0.5%, preferably, 0.3%, and more preferably 0.2%.

Nb: 0.05 to 0.5%

Niobium has an action of fining the grain in heat treatment such as an oil tempering process (quenching and tempering), because niobium forms niobium carbonitride having a pinning effect, thereby contributing to improvement on toughness and ductility of the spring steel. In order to secure these effects sufficiently, the niobium content is 0.05% or higher, and preferably, 0.10% or higher. An excessive addition of niobium, however, may cause aggregation of niobium carbonitride, which may lead to oversized growth of crystal grains. In view of this, an upper limit of the niobium content is 0.5%, and preferably, 0.3%.

The inventive steel wire for spring is normally constituted of a composite structure comprising tempered martensite and retained austenite, namely, austenite remaining after cooling to room temperature. Normally, in the inventive steel wire, the tempered martensite occupies, for example, 90 area % or more, and the retained austenite occupies about 5 to 10 area %.

In the inventive steel wire and the inventive spring, normally, the grain size number of prior austenite is 11.0 or larger, preferably 13 or larger. The larger the grain size number is, namely, the smaller the grain size is, the more effectively improvement on fatigue life and sag resistance is obtainable. The grain size number can be increased by regulating the amounts of elements capable of fining the grain, such as Cr, Al, V, and Nb, or by raising the heating rate before quenching, during the oil tempering process.

The inventive steel wire, namely, an oil-tempered wire, and the inventive spring have a proof stress ratio (offset yield strength ratio; $\sigma_{0.2}/\sigma_B$), namely, a ratio of 0.2% proof stress ($\sigma_{0.2}$) to tensile strength ($\sigma_B$) at 0.85 or lower, and preferably 0.80 or lower. The less the proof stress ratio after the oil tempering process is, the more effectively breakage trouble in a coiling process can be avoided, thereby improving cold workability. The proof stress ratio can be minimized by, for example, raising the cooling rate after tempering in the oil tempering process, by water cooling or the like.

The inventive steel wire and the inventive spring have high strength because the composition of alloy elements is appropriately regulated. Further, since the grain size and the proof stress ratio of the inventive steel wire are properly regulated, the inventive spring is provided with superior fatigue life, and sag resistance without sacrificing cold workability of the steel wire. The Vickers hardness of the core part of the steel wire (and the spring) can be optionally adjusted by heat treatment or the like, other than regulating the composition of the alloy elements. The Vickers hardness (Hv) of the core part of the steel wire (and the spring) is, for example, 550 or higher, preferably, 570 or higher, and more preferably, 600 or higher. The Vickers hardness (Hv) may be, for example, about 700 or lower, or about 650 or lower. The surface hardness of the inventive steel wire and the inventive spring can be further increased by surface hardening, such as a nitriding process. For instance, a nitride-processed spring, namely, a spring with a nitriding layer being formed on the surface thereof has a surface hardness (Hv) of about 750 or higher, preferably, about 800 or higher, and about 1150 or lower, preferably, about 1100 or lower.

It is desirable that the 0.2% proof stress ($\sigma_{0.2}$) of the inventive spring steel wire for spring, namely, the oil-tempered wire after an annealing process of 400° C. for 20 minutes is raised by 300 MPa or higher, preferably, 350 MPa or higher, than that before the annealing process. The greater the variation ($\Delta\sigma_{0.2}$) of the 0.2% proof stress is, the more sag resistance can be improved. Similarly to the proof stress ratio, the variation ($\Delta\sigma_{0.2}$) can be maximized by raising the cooling rate after the oil tempering process (quenching and tempering) by water cooling or the like.

It is desirable that the inventive spring has a strong compressive residual stress on the surface of the spring. The stronger the compressive residual stress is, the more effectively fatigue life of the spring can be prolonged. A desired compressive residual stress differs depending on a state of the spring whether a nitriding process has been implemented. If a nitriding process is not applied, a desired compressive residual stress is, for instance, −400 MPa or lower, preferably, −500 MPa or lower, and more preferably, −600 MPa or lower. A negative residual stress represents that the spring is in a compressed state, whereas a positive residual stress represents that the spring is in an extended state. The larger the absolute value of the compressive residual stress, the stronger the residual stress is. If a nitriding process is applied, namely, a nitriding layer is formed on the spring surface, a compressive residual stress is, for instance, about −800 MPa or lower, preferably, about −1000 MPa or lower, and more preferably, about −1200 MPa or lower. The compressive residual stress on the spring surface can be strengthened by, for example, increasing the number of cycles of shot peenings, such as twice or more.

It is desirable that the inventive spring has a deeper crossing point. The crossing point is a depth-wise position from the surface of the spring where a measured residual stress turns from a compression to a tension. The deeper the crossing point is, the larger the region where the compressive residual stress is exerted is, thereby contributing to improvement on fatigue life of the springs. The crossing point is 0.05 mm or more, preferably, 0.10 mm or more, and more preferably, 0.15 mm or more, and 0.5 mm or less, preferably, 0.4 mm or less, and more preferably, 0.35 mm or less in depth from the surface of the spring. The crossing point can be deepened by, for example, increasing the number of cycles of shot peenings, such as twice or more, or by increasing the average diameter of grains used for shot peening, for instance, by using the grains of the average diameter (i.e. average grain size) ranging from about 0.7 to 1.2 mm in the first shot peening.

In the case where the inventive spring has been applied with surface hardening such as a nitriding process, it is desirable to increase the thickness of the hard layer, which is a layer having a hardness (Hv) larger than the hardness of the core part by 15 or more. The larger the thickness of the hard layer is, the more effectively generation of fatigue crack can be suppressed, thereby contributing to improvement on fatigue properties of the springs. The thickness of the hard layer is, for instance, 0.02 mm or more, preferably, 0.03 mm or more, and more preferably, 0.04 mm or more, 0.15 mm or less, preferably, 0.13 mm or less, and more preferably, 0.10 mm or less. The thickness of the hard layer can be increased by extending the nitriding time or by raising the nitriding temperature.

In the present invention, a steel wire for high-strength spring and high-strength spring are produced by properly regulating the composition of the alloy elements. Further, an effective amount of chromium is added, and the grain size and the proof stress ratio of the steel wire are properly adjusted. Thereby, the springs having superior fatigue life, and sag resistance are produced without sacrificing cold workability of the steel wire.

EXAMPLES

In the following, the present invention is illustrated in detail with Examples, which, however, do not limit the present invention. Adequate modification is allowable as far as it does not depart from the object of the present invention described above or below, and every such modification is intended to be embraced in the technical scope of the present invention.

Example 1

Steel materials A through R respectively having the chemical compositions as shown in Table 1, with remainder essentially consisting of Fe and inevitable impurities, were melted, poured into a mold, and subjected to hot rolling, and steel wire rods each having a diameter of 8.0 mm were produced. Then, the steel wire rods were subjected to softening, shaving, lead patenting (heating temperature: 950° C., lead furnace temperature: 620° C.), followed by wire drawing, whereby the rod was drawn into a wire having a diameter of 4.0 mm. After the wire drawing, the drawn wire was subjected to an oil tempering process (heating rate before quenching: 250° C./sec., heating temperature: 960° C., oil temperature in quenching: 70° C., tempering temperature: 450° C., cooling rate after tempering: 300° C./sec., furnace atmosphere: 100 vol. % of $H_2O$+90 vol. % of $N_2$), thereby producing oil-tempered wires (steel wires).

Regarding the steel material E2, air-cooling was conducted after the tempering in the oil tempering process. Regarding the steel material H2, a heating rate before the quenching in the oil tempering process was set at 20° C./sec.

These oil-tempered wires have the thickness of the oxide layer in grain boundaries of 10 μm or less, and other properties thereof were evaluated with respect to the following items.

(1) Tensile Strength ($\sigma_B$), 0.2% Proof Stress ($\sigma_{0.2}$), and Grain Size Number:

A tensile test was conducted with respect to the oil-tempered wires. The tensile strength ($\sigma_B$) and 0.2% proof stress ($\sigma_{0.2}$) were measured with respect to the oil-tempered wires, and respective ratios ($\sigma_{0.2}/\sigma_B$) were calculated. The grain size number of prior austenite was measured according to Japanese Industrial Standard (JIS) G0551.

(2) Variation ($\Delta\sigma_{0.2}$) of 0.2% Proof Stress After Annealing for Stress Relieving:

After the oil-tempered wires were subjected to low-temperature annealing at 400° C. for 20 minutes, 0.2% proof stress ($\sigma_{0.2}$) of the wires was measured, and a variation ($\Delta\sigma_{0.2}$) was calculated by subtracting the 0.2% proof stress ($\Delta\sigma_{0.2}$) before the low-temperature annealing from the 0.2% proof stress ($\sigma_{0.2}$) after the low-temperature annealing.

(3) Workability:

A winding test was conducted with respect to the oil-tempered wires according to JIS G 3560, in which the number of cycles of windings was 10.

(4) Fatigue Life, Residual Shear Strain:

The oil-tempered wires were formed into springs by cold coiling (average diameter of coil: 24.0 mm, the number of cycles of windings: 6.0, number of active coils: 3.5), followed by annealing for stress relieving (400° C.×20 min.), grinding, nitriding process (nitriding conditions: 80 vol. % of $NH_3$+20 vol. % of $N_2$, 430° C.×3 hr.), shot-peening [number of cycles of shot-peenings: thrice, average diameter of grains used for the first shot-peening: 1.0 mm, average diameter of grains used for the first through third shot-peenings: 0.5 mm], low-temperature annealing (230° C.×20 min.), and cold setting.

A fatigue test was conducted with respect to the springs under a load stress of 760±650 MPa in warm state (120° C.). The fatigue test was repeated until breakage of the springs was observed, and the number of cycles of the fatigue tests until breakage of the springs was observed was counted. Thus, the fatigue life of the springs was defined. In the case where breakage did not occur in the springs after repeated fatigue tests, the fatigue test was terminated when the number of cycles of the fatigue tests reached ten million cycles.

Further, the springs were fastened under a load stress of 1372 MPa for 48 consecutive hours at 120° C. Thereafter, the stress was relieved, and a residual shear strain was calculated by measuring the sag before and after the fastening.

(5) Hardness, Residual Stress:

The oil-tempered wires were formed into springs in a similar manner as the springs were formed in the section (4) fatigue life and residual shear strain. The Vickers hardness (Hv) on the spring surfaces was measured by a so-called "code method" in which the Vickers hardness (load of 300 gf) was measured with respect to the test piece whose surface was polished, and the thus obtained Vickers hardness was converted into a corresponding value in a vertical direction. Further, the springs were cut at an appropriate position thereof, and the Vickers hardness (Hv) of the core part, and the Vickers hardness (Hv) of the hard layer having a hardness (Hv) higher than that of the core part by 15 or more were calculated, as well as the depth of a hard layer by JIS Z 2244 by measuring the Vickers hardness (Hv) on the cross section of the springs. Further, the compressive residual stress on the spring surfaces, and the crossing point corresponding to a certain depthwise position where the measured residual stress turned from a compression to a tension were calculated by measuring the residual stress by an X-ray diffraction method.

The results of measurements are shown in Table 2.

TABLE 1

| Kind of Steel | Chemical composition (mass %)* | | | | | | | | |
|---|---|---|---|---|---|---|---|---|---|
| | C | Si | Mn | Cr | Ni | V | Mo | Nb | Al |
| A | 0.61 | 1.95 | 0.82 | 1.68 | 0.00 | 0.281 | — | — | 0.003 |
| B | 0.57 | 2.03 | 0.72 | 1.74 | 0.20 | 0.296 | — | — | 0.003 |
| C | 0.60 | 2.03 | 0.73 | 1.75 | 0.20 | 0.296 | — | — | 0.032 |
| D | 0.61 | 2.04 | 0.73 | 1.75 | 0.20 | 0.164 | — | — | 0.002 |
| E1, E2 | 0.61 | 2.03 | 0.72 | 1.43 | 0.20 | 0.295 | — | — | 0.003 |
| F | 0.66 | 2.03 | 0.75 | 1.75 | 0.21 | 0.295 | — | — | 0.003 |
| G | 0.60 | 1.99 | 0.73 | 2.04 | 0.21 | 0.153 | — | — | 0.003 |
| H1, H2 | 0.60 | 1.99 | 0.73 | 1.74 | 0.22 | — | 0.15 | — | 0.001 |
| I | 0.65 | 1.31 | 0.85 | 1.71 | 0.00 | 0.110 | 0.12 | — | 0.008 |
| J | 0.56 | 1.75 | 1.21 | 1.55 | 0.00 | — | — | 0.22 | 0.020 |
| K | 0.62 | 1.85 | 0.31 | 1.60 | 0.00 | 0.251 | — | — | 0.001 |
| L | 0.55 | 1.45 | 0.70 | 0.70 | 0.00 | — | — | — | 0.002 |
| M | 0.63 | 1.40 | 0.60 | 0.65 | 0.00 | 0.110 | — | — | 0.003 |
| N | 0.60 | 1.50 | 0.70 | 0.90 | 0.25 | 0.060 | — | — | 0.003 |
| O | 0.61 | 2.00 | 0.85 | 1.05 | 0.25 | 0.110 | — | — | 0.002 |
| P | 0.47 | 1.81 | 0.92 | 1.55 | 0.00 | 0.145 | — | — | 0.003 |
| Q | 0.82 | 0.78 | 0.82 | 0.25 | 0.00 | — | — | — | 0.002 |
| R | 0.62 | 1.93 | 0.86 | 1.62 | 0.00 | 0.221 | — | — | 0.070 |

*Remainder comprises Fe and inevitable impurities.

TABLE 2

| No. | Kind of Steel | $\sigma_{0.2}/\sigma_B$ | Grain size number | $\Delta\sigma_{0.2}$ | Hardness(Hv) Surface | Hardness(Hv) Core Part | Hard layer depth (mm) | Compressive residual stress on surface (MPa) | Crossing point (mm) | coiling test | Fatigue life ($\times 10^5$) | Residual shear strain (%) |
|---|---|---|---|---|---|---|---|---|---|---|---|---|
| 1 | A | 0.75 | 13.0 | 317 | 911 | 607 | 0.11 | −1455 | 0.25 | OK | ≧100 | 0.135 |
| 2 | B | 0.79 | 14.0 | 329 | 974 | 615 | 0.10 | −1591 | 0.24 | OK | ≧100 | 0.130 |
| 3 | C | 0.78 | 14.0 | 390 | 940 | 631 | 0.13 | −1640 | 0.25 | OK | ≧100 | 0.123 |
| 4 | D | 0.74 | 13.5 | 425 | 815 | 620 | 0.10 | −1480 | 0.21 | OK | ≧100 | 0.135 |
| 5 | E1 | 0.81 | 14.0 | 375 | 841 | 617 | 0.13 | −1457 | 0.22 | OK | ≧100 | 0.130 |
| 6 | E2 | 0.89 | 13.0 | 263 | 830 | 622 | 0.12 | −1570 | 0.22 | breakage | ≧100 | 0.171 |
| 7 | F | 0.78 | 13.5 | 380 | 889 | 613 | 0.11 | −1369 | 0.21 | OK | ≧100 | 0.125 |
| 8 | G | 0.67 | 13.5 | 442 | 823 | 618 | 0.10 | −1499 | 0.24 | OK | ≧100 | 0.123 |
| 9 | H1 | 0.67 | 13.5 | 351 | 817 | 630 | 0.06 | −1463 | 0.25 | OK | ≧100 | 0.149 |
| 10 | H2 | 0.82 | 10.5 | 215 | 833 | 605 | 0.08 | −1380 | 0.22 | OK | 31 | 0.250 |
| 11 | I | 0.75 | 12.0 | 320 | 850 | 571 | 0.12 | −1464 | 0.19 | OK | ≧100 | 0.175 |
| 12 | J | 0.78 | 14.0 | 342 | 822 | 596 | 0.08 | −1552 | 0.19 | OK | ≧100 | 0.128 |
| 13 | K | 0.81 | 13.5 | 331 | 905 | 620 | 0.17 | −1582 | 0.23 | OK | ≧100 | 0.127 |
| 14 | L | 0.92 | 10.5 | 45 | 733 | 553 | 0.08 | −1030 | 0.23 | OK | 4 | 0.348 |
| 15 | M | 0.91 | 11.0 | 60 | 738 | 561 | 0.09 | −1105 | 0.25 | OK | 7 | 0.250 |
| 16 | N | 0.92 | 12.0 | 51 | 750 | 559 | 0.09 | −987 | 0.24 | OK | 6 | 0.245 |
| 17 | O | 0.89 | 12.0 | 95 | 802 | 581 | 0.12 | −1235 | 0.24 | OK | 18 | 0.215 |
| 18 | P | 0.86 | 10.0 | 122 | 811 | 530 | 0.12 | −847 | 0.21 | breakage | 2 | 0.322 |
| 19 | Q | 0.95 | 10.0 | 17 | 711 | 589 | 0.06 | −830 | 0.18 | breakage | 7 | 0.301 |
| 20 | R | 0.83 | 13.0 | 357 | 845 | 625 | 0.12 | −1489 | 0.23 | OK | 2 | 0.141 |

As is obvious from Tables 1 and 2, No. 18 fails to provide a required strength due to an insufficient carbon content, thereby failing to provide sufficient fatigue life and sag resistance. No. 20 suffers from short fatigue life, because an excessive aluminum content generates oversized growth of oxide inclusions, thereby causing breakage of the spring. Nos. 14-17, and 19 cannot attain sufficient fatigue life because of an insufficient chromium content.

On the contrary, the chemical compositions of Nos. 1-5, 7-9, and 11-13 are properly adjusted, and an appropriate amount of chromium is added in these examples. Further, the grain size and the proof stress ratio are properly controlled. Thanks to these adjustments, Nos. 1-5, 7-9, and 11-13 provide superior fatigue life, and sag resistance without sacrificing workability of the steel wire.

As is obvious from No. 6, improper setting of conditions regarding the proof stress ratio ($\sigma_{0.2}/\sigma_B$) and the variation ($\Delta\sigma_{0.2}$) of 0.2% proof stress leads to poor workability. Also, No. 6 cannot provide sufficient sag resistance, although the sag resistance in No. 6 is improved, as compared with Example Nos. 14-17.

Further, as is obvious from No. 10, an increase in grain size, namely, a decrease in grain size number cannot provide sufficient fatigue life and sag resistance, although these properties are improved in No. 10, as compared with Example Nos. 14-17.

INDUSTRIAL APPLICABILITY

The inventive steel wire and the inventive spring have superior fatigue properties, sag resistance, and workability. Accordingly, the present invention is particularly useful in the field where these properties are required, for instance, in production of springs that are used in spring mechanisms of machines, such as valve springs for automotive engines, suspension springs, clutch springs, and brake springs.

The invention claimed is:

1. A steel wire for a high-strength spring having superior workability, the steel wire comprising tempered martensite, and comprising by mass:

C: 0.53 to 0.68%;

Si: 1.2 to 2.5%;

Mn: 0.2 to 1.5%;

Cr: 1.4 to 2.5%;

Al: 0.05% or less, excluding 0%;

at least one member selected from the group consisting of Ni: 0.4% or less, excluding 0%; V: 0.4% or less, excluding 0%; Mo: 0.05 to 0.5%; and Nb: 0.05 to 0.5%; and a remainder consisting essentially of Fe and inevitable impurities;

wherein:

the steel wire has a prior austenite grain size number of from 11.0 to 14.0; and a ratio ($\sigma_{0.2}/\sigma_B$) of 0.2% proof stress ($\sigma_{0.2}$) to tensile strength ($\sigma_B$) in the steel wire is from 0.67 to 0.85.

2. The steel wire according to claim 1, wherein the content of manganese ranges from 0.5 to 1.5%.

3. The steel wire according to claim 1, wherein the 0.2% proof stress ($\sigma_{0.2}$) is raised by 300 MPa or more when annealing at 400° C. for 20 minutes is conducted.

4. A high-strength spring formed of the steel wire according to claim 1.

5. The high-strength spring according to claim 4, wherein:

the spring has a core part of a hardness Hv ranging from 550 to 700;

the spring has a compressive residual stress on an surface thereof at −400 MPa or lower; and the residual stress of the spring is changed from a compression to a tension at a depth of from 0.05 mm to 0.5 mm from the surface of the spring.

6. The high-strength spring according to claim 4, wherein:

the spring has a nitriding layer on a surface thereof;

the spring has a hardness Hv ranging from 750 to 1150 on the surface thereof;

the spring has a core part of a hardness Hv ranging from 550 to 700;

the spring has a hard layer of a hardness Hv larger than the hardness of the core part by 15 or more, the hard layer having a depth ranging from 0.02 mm to 0.15 mm;

the spring has a compressive residual stress on an surface thereof at −800 MPa or lower; and the residual stress of the spring is changed from a compression to a tension at a depth of from 0.05 mm to 0.5 mm from the surface of the spring.

7. The high-strength spring according to claim 4, wherein, when the spring is subjected a fatigue test under a load stress of 760±650 MPa at a temperature of 120° C., the spring is capable of undergoing ten million cycles without breakage.

* * * * *

UNITED STATES PATENT AND TRADEMARK OFFICE

CERTIFICATE OF CORRECTION

PATENT NO. : 8,007,716 B2
APPLICATION NO. : 10/549753
DATED : August 30, 2011
INVENTOR(S) : Sumie Suda et al.

It is certified that error appears in the above-identified patent and that said Letters Patent is hereby corrected as shown below:

On the title page, Item (54), and column 1, line 1, the title is incorrect. Item (54) and column 1 should read:

-- STEEL WIRE FOR HIGH STRENGTH SPRING EXCELLENT IN WORKABILITY AND HIGH STRENGTH SPRING --

Signed and Sealed this
Twenty-seventh Day of December, 2011

David J. Kappos

David J. Kappos
*Director of the United States Patent and Trademark Office*